US010780468B2

(12) United States Patent
Luo et al.

(10) Patent No.: US 10,780,468 B2
(45) Date of Patent: Sep. 22, 2020

(54) CLEANING DEVICE AND CLEANING METHOD

(71) Applicants: BOE TECHNOLOGY GROUP CO., LTD., Beijing (CN); Beijing BOE Display Technology Co., Ltd., Beijing (CN)

(72) Inventors: Junwen Luo, Beijing (CN); Bin Chang, Beijing (CN); Shichao Fan, Beijing (CN); Lijun Yin, Beijing (CN); Hui Sun, Beijing (CN); Hongyang Tang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 180 days.

(21) Appl. No.: 15/993,879

(22) Filed: May 31, 2018

(65) Prior Publication Data

US 2019/0054509 A1 Feb. 21, 2019

(30) Foreign Application Priority Data

Aug. 17, 2017 (CN) ..... 2017 1 0708404

(51) Int. Cl.

| | |
|---|---|
| ***B08B 7/04*** | (2006.01) |
| ***B08B 3/02*** | (2006.01) |
| ***B08B 5/02*** | (2006.01) |
| ***B08B 1/00*** | (2006.01) |

(Continued)

(52) U.S. Cl.

CPC ..... *B08B 7/04* (2013.01); *B08B 1/008* (2013.01); *B08B 1/02* (2013.01); *B08B 3/022* (2013.01); *B08B 5/023* (2013.01); *B08B 1/002* (2013.01); *B08B 11/02* (2013.01); *B08B 2220/01* (2013.01); *B08B 2230/01* (2013.01)

(58) Field of Classification Search

None

See application file for complete search history.

(56) References Cited

U.S. PATENT DOCUMENTS

| | | | | |
|---|---|---|---|---|
| 6,260,231 | B1 * | 7/2001 | Bybee | F26B 5/14 15/309.2 |
| 6,809,809 | B2 * | 10/2004 | Kinney | G01N 21/9501 356/237.1 |
| 2015/0239021 | A1 * | 8/2015 | Ponomarev | B08B 7/04 134/1 |

FOREIGN PATENT DOCUMENTS

| | | | |
|---|---|---|---|
| CN | 206253383 | U | 6/2017 |
| JP | 2008212862 | A | 9/2008 |

OTHER PUBLICATIONS

CN206253383U translation from espacenet.com (Year: 2016).*

(Continued)

*Primary Examiner* — Rita P Adhlakha

(74) *Attorney, Agent, or Firm* — Calfee, Halter & Griswold LLP

(57) ABSTRACT

The present disclosure discloses a cleaning device and a clean method, the cleaning device includes a sweeping module and a washing module, the sweeping module includes a brush component and a steam generating component, the steam generating component and the brush component are arranged in sequence in the cleaning direction of the cleaning device; the washing module is configured to wash the parts to be cleaned, the washing module and the sweeping module are arranged in sequence in the cleaning direction of the cleaning device.

12 Claims, 7 Drawing Sheets

(51) Int. Cl.
*B08B 1/02* (2006.01)
*B08B 11/02* (2006.01)

(56) References Cited

OTHER PUBLICATIONS

Third Office Action for Chinese Patent Application No. 201710708404.X dated Dec. 18, 2019.
First Office Action for Chinese Patent Application No. 201710708404.X dated Mar. 1, 2019.

* cited by examiner

CLEANING DEVICE AND CLEANING METHOD

CROSS-REFERENCE TO RELATED APPLICATIONS

This application is based on and claims priority to Chinese Patent Application No. 201710708404.X, filed on Aug. 17, 2017, the contents of which are incorporated herein by reference in its entirety.

TECHNICAL FIELD

The present disclosure relates to the display field, in particular to a cleaning device for cleaning the electronics and the cleaning method corresponding to the cleaning device.

BACKGROUND

In the display panel manufacturing industry, especially the liquid crystal panel manufacturing industry, it is usually necessary to clean the display cell to remove the foreign matter on the surface of the display cell before attaching the polarizing film (POL) on the display cell which has been cut.

At present, the cleaning devices in related art usually uses normal-temperature water, i.e., cold water, to wash the display cell, and then wipes and cleans the display cell by using abrasive belt, abrasive pad (PAD) or abrasive cloth to clean the display cell, so as to clean the display cell. The risk that residual adhesive may remain at the display cell exists in all the pre-process sections such as process of preparing the array substrate, pasting the color film, manufacturing the display cell and the like, and the residual adhesive and feculence-like foreign matter adhering to the surface of the display cell will cause the product's yield to decline after adhering the polarizing film to the display cell. According to the data statistics, 20% of the defective display panel due to bubble type is caused by the residual adhesive at the display cell.

The cleaning process in related art mainly exists the following defects:

On the one hand, the cleaning device in related art generally uses normal temperature water, i.e., cold water, to clean, which generally difficult to completely remove the feculence, in particular the cured organic oil, from the surface of the display cell.

On the other hand, the cleaning device in related art may easily cause the display device to be damaged due to larger local stress, and may even cause the display cell to be damaged.

The information as above disclosed in the background is merely employed to enhance understanding of background of this disclosure.

SUMMARY

According to one aspect of this disclosure, providing a cleaning device which comprises sweeping module and washing module. The sweeping module includes a brush component and a steam generating component, the steam generating component and the brush component are arranged in sequence in the cleaning direction of the cleaning device; the washing module is configured to wash the parts to be cleaned, the washing module and the sweeping module are arranged in sequence in the cleaning direction of the cleaning device.

According to an embodiment of the disclosure, the brush component comprises a brush, an actuator, a pressure sensor and a controller, a cleaning face of the brush is disposed towards and parallel to the part to be cleaned; the actuator is configured to drive the brush to move; the pressure sensor is configured to measure a pressure of the cleaning face of the brush, and transmit a pressure signal to the controller; the controller is electrically connected to the actuator and the pressure sensor respectively; the controller is configured to receive the pressure signal from the pressure sensor, and generate a control signal according to the pressure signal for transmitting to the actuator.

According to an embodiment of the disclosure, the brush is a plate-type brush which comprises a plate body part and a brush part, the plate part has a first surface which is parallel to the cleaning face, the brush part is disposed on the first surface, and a extend direction of a brushing of the brush part is perpendicular to the first surface; the plate body part is connected with the actuator.

According to an embodiment of the disclosure, the steam generating component comprises a steam generator and a steam ejector, a steam generated by the steam generator is sprayed by the steam ejector to a surface to be cleaned of the part to be cleaned.

According to an embodiment of the disclosure, a temperature of the steam is greater than 90° C.

According to an embodiment of the disclosure, the cleaning device further comprises a cleaning fluid supply module which comprises a liquid vessel and a pipeline, the pipeline is communicated with the sweeping module and the washing module respectively.

According to an embodiment of the disclosure, in a direction of movement of the part to be cleaned, the washing module comprises a first cleaning portion, a second cleaning portion and a final cleaning portion arranged in sequence, the liquid vessel comprises a first liquid vessel and a second liquid vessel separated from each other, a liquid outlet of the first liquid vessel is communicated with the final cleaning portion, a liquid outlet of the second liquid vessel is communicated with the first cleaning portion and the second cleaning portion respectively, the liquid outlet of the first cleaning portion, the liquid outlet of the second cleaning portion and a liquid outlet of the final cleaning portion are communicated with a liquid return port of the second liquid vessel respectively.

According to an embodiment of the disclosure, the cleaning fluid supply module further comprises a heating device, which is configured to heat the cleaning fluid and disposed on the pipeline, and/or in the liquid vessel.

According to an embodiment of the disclosure, a temperature of the cleaning fluid after being heated by the heating device is about 40° C. to 50° C.

According to an embodiment of the disclosure, the cleaning device further comprises a camera device, an air knife unit and an optical detection device, the camera device, the sweeping module, the washing module, the air knife unit and the optical detection device are sequentially arranged in the cleaning direction in sequence.

According to another aspect of this disclosure, providing a cleaning method, wherein the cleaning method uses the cleaning device according to claim 1 for cleaning, the cleaning method comprises the following steps:

generating steam by the steam generating component to act on the part to be cleaned;

sweeping one surface of the part to be cleaned by the brush component;

after the one surface is swept, then sweeping the other surface, which is opposite to the one surface; and washing the part to be cleaned after being swept with the washing module.

According to an embodiment of the disclosure, the steam generating component comprises a steam generator and a steam ejector, the step of generating steam by the steam generating component to act on the part to be cleaned comprises:

heating cleaning fluid from liquid into steam by the steam generator, and spraying the steam on the part to be cleaned by the steam ejector.

According to an embodiment of the disclosure, the cleaning device further comprises a cleaning fluid supply module which is configured to transport cleaning fluid to the sweeping module and the washing module, the cleaning fluid module comprises a heating device, before the step of washing the part to be cleaned after being swept with the washing module, heating the cleaning fluid by the heating device.

According to an embodiment of the disclosure, the part to be cleaned is a display panel.

BRIEF DESCRIPTION OF THE DRAWINGS

The foregoing aspects, features and advantages of the present disclosure will become more apparent from the following detailed description thereof when taken in conjunction with the accompanying drawings. The companying drawings are merely illustrative but not necessarily to scale. Wherever possible, the same reference numbers will be used throughout the drawings to refer to the same or like parts. Wherein.

DETAILED DESCRIPTION

Figure 1:
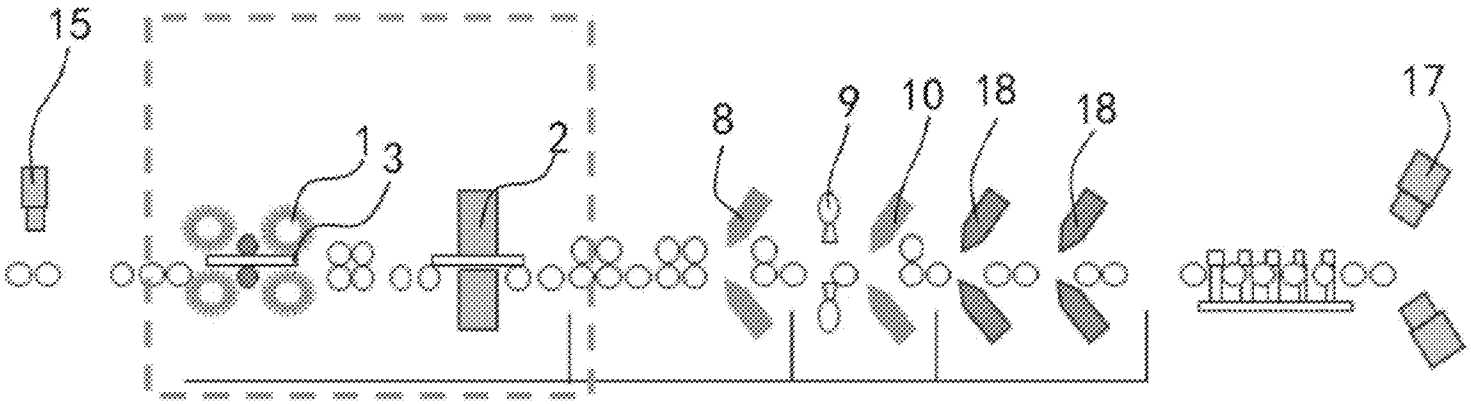
FIG. 1 is a flow chart of a cleaning device according to an embodiment.

Exemplary implementations will now be described sufficiently with reference to the accompanying drawings. However, the exemplary implementations can be carried out in variety of forms, but should not be construed as limiting the embodiments set forth herein. Rather, these implementations are provided such that this disclosure will be thorough and complete, and will transmit concepts of the exemplary implementations completely to those skilled in the art. The same reference numbers in the drawings serve to denote the same or similar structures, and accordingly their detailed descriptions will be omitted.

The cleaning device provided by the present disclosure is suitable for a display panel and can also be applied to other electronic components, and is within the protection scope of the present disclosure. In order to describe the present disclosure more clearly, the present disclosure uses a display panel as the part to be cleaned as an example. Upstream and downstream defined in the present disclosure are defined according to the direction of movement of the display panel, the display panel moves from upstream to downstream, the direction of movement from upstream to downstream can be defined as a cleaning direction, that is, the direction of movement of the display panel can be defined as the cleaning direction.

An embodiment of the present disclosure provides a cleaning device, as shown in FIG. 1, the cleaning device wipes the surface of the display cell with cleaning tools such as a nylon roller brush 1, an abrasive belt 2 and the like, the abrasive belt 2 is usually used to just rub against residual adhesive, which usually thins the thickness of the residual adhesive, while largens the area of the residual adhesive, therefore, not only does it not remove the residual adhesive, it increases the amount of clean work; in addition, since the contact surface of the roller brush 1 and the display panel 3 is usually the outer peripheral surface of the roller brush, almost linear contact between the two, which easily causes damage to the display device due to larger local stress.

Figure 2:
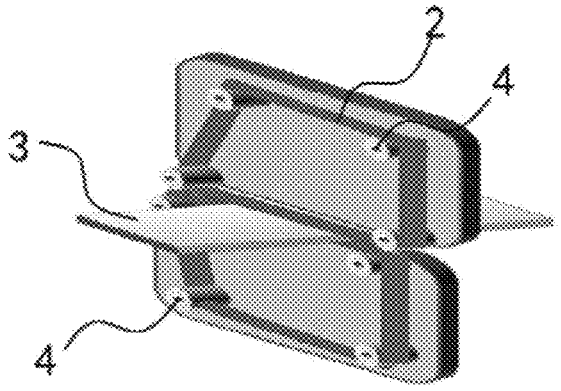
FIG. 2 is a schematic diagram of the working principle of an abrasive belt in FIG. 1.

On another aspect, in order to meet the market demand, the current display unit tends to a development of thin type, as shown in FIG. 2, the cleaning device of the present embodiments is provided with two abrasive belts 2 on the two opposite sides of the display cell 3, the two abrasive belts 2 respectively rotate under the drive of the respective driving rollers 4, the two abrasive belts 2 produce friction in two opposite directions to the display cell, that is to say, in the cleaning process for the display cell by the abrasive belts 2, a side of display cell where the thin film transistor (TFT) is disposed and a side of display cell where the color film (CF) need to be subjected to friction cleaning at the same time, so that the display cell receives the opposite force at the same time, which affects the structural strength of the display cell, even causes damage to the display cell.

Figure 3:
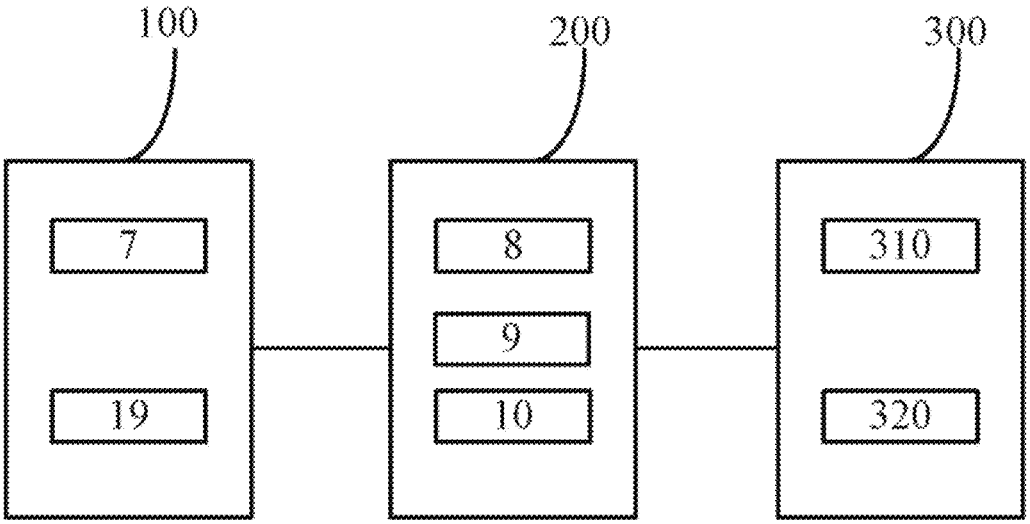
FIG. 3 is a block diagram of a cleaning device according to another embodiment.
Figure 4:
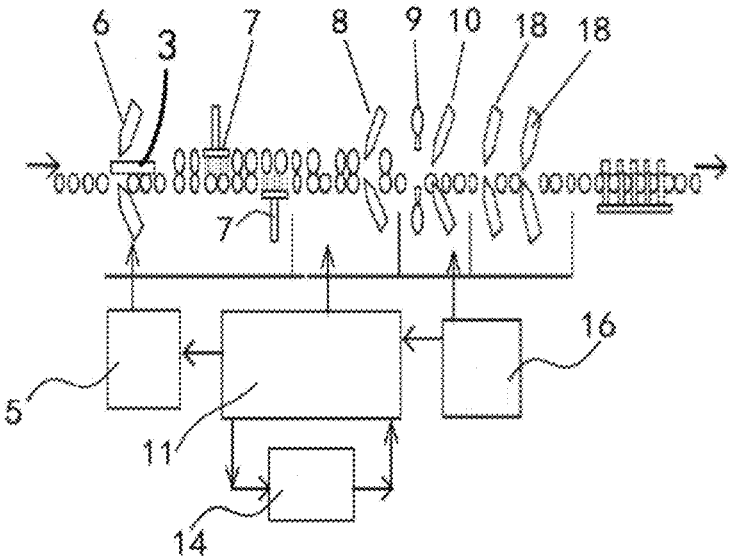
FIG. 4 is a flow chart of a cleaning device according to another embodiment.
Figure 5:
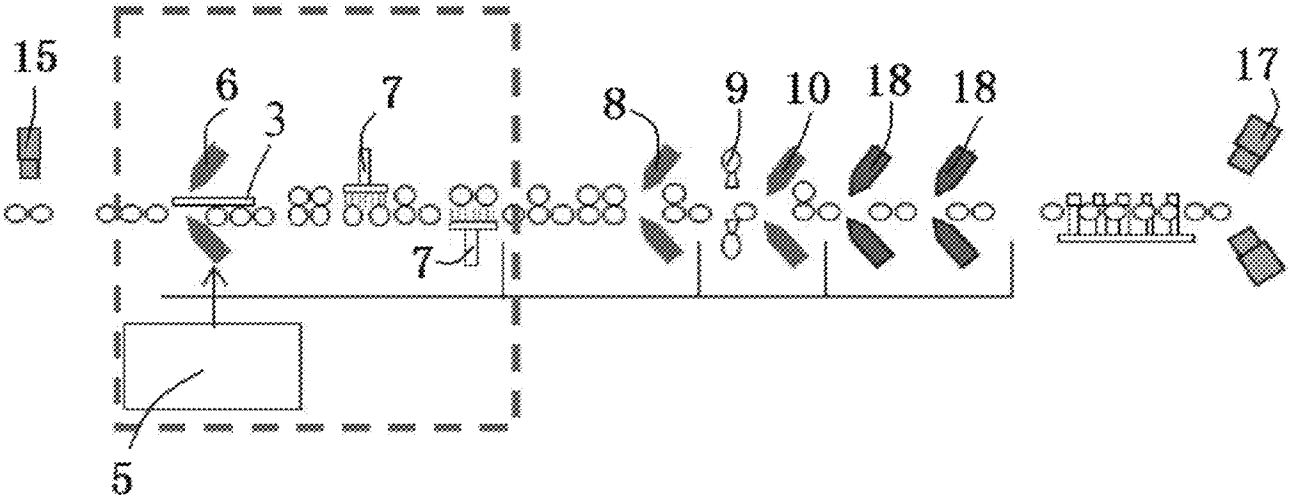
FIG. 5 is a flow chart of a sweeping module and washing module in FIG. 4.

Refer to FIG. 3 to FIG. 5, according to an aspect of the present disclosure, there is provided a cleaning device which may include a sweeping module 100 and a washing module 200. The sweeping module 100 includes a brush component 7 and a steam generating component 19, the steam generating component and the brush component 7 are sequentially arranged in the cleaning direction of the cleaning device. The washing module 200 is used to wash a part to be cleaned, and the washing module 200 and the sweeping module 100 are sequentially disposed in the cleaning direction of the cleaning device.

The cleaning device may include a camera device 15, a sweeping module 100, a washing module 200, an air knife unit 18 and an optical detection device 17 which are sequentially arranged in the cleaning direction of the cleaning device, specific description please refer to the following description. The direction of arrow in FIG. 4 is the flow direction of the cleaning fluid. With continued reference to FIG. 4 and FIG. 5, according to a specific embodiment of the disclosure, wherein the sweeping module 100 may be located at upstream of the cleaning device, the steam generating component 19 may be located at upstream of the brush component 7. In the process of cleaning the display panel 3, the display panel 3 may first pass through the steam generating component 19 which may generate hot steam acting on the surface of the display panel 3. In the present disclosure, steam is generated by the steam generating component 19 and applied to the surface of the display panel 3 to be cleaned, thus the dirt remaining on the surface of the display panel 3, for example but not limited to residual gel, can be soaked and softened. The display panel 3 of which the dirt on the surface has been softened is further cleaned by the brush component 7, so that the cleaning efficiency would be improved.

Figure 10:
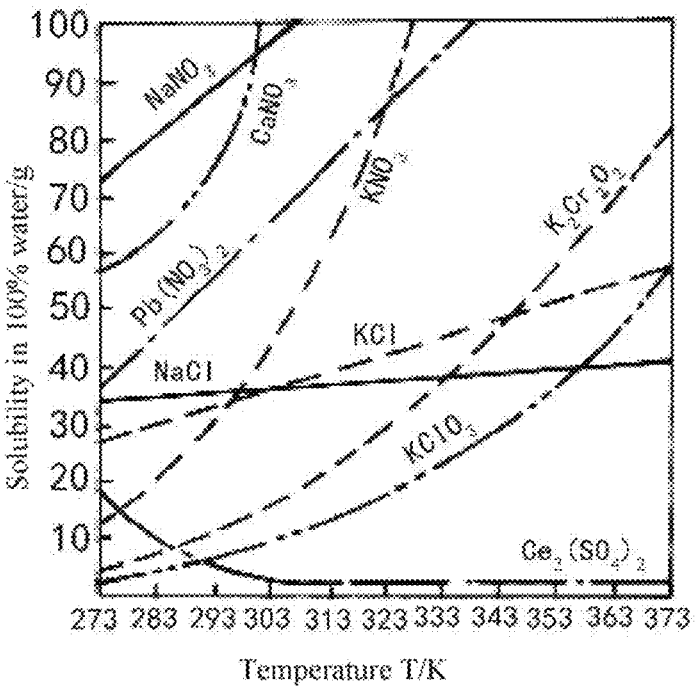
FIG. 10 is a water temperature-solubility curve.

With continued reference to FIG. 4 and FIG. 5, according to a specific embodiment of the disclosure, wherein the steam generating component 19 may include a steam generator 5 and a steam ejector 6, the steam generator 5 can be used to generate steam which can be sprayed onto the surface to be cleaned of the display panel 3 via the steam ejector 6, but not limited thereto. According to one specific implementation of the present disclosure, wherein the cleaning fluid may be clean water, it can also be a cleaning solution formed by adding some kinds of organic solvent to clean water, all of which are contained within the protection scope of the disclosure, those skilled in the art can choose according to actual needs. Since the cleaning fluid is not an important disclosure point of the present disclosure, it will not be repeated here, the dirt may be, for example but not limited to, an original condensate, oil thereof can be decomposed, softened and dissolved with the help of the steam. Refer to FIG. 10, in case that clear water is used as a cleaning fluid, wherein it can be understood that the higher the temperature of the clear water, the greater its solubility. In addition, also refer to table 1, as the water temperature of the clean water rises, the surface tension of the clean water will decrease, so that its viscosity decreases, thusly improving the ability of soak. According to the actual needs, the steam temperature can be adjusted, for example but not limited to an embodiment according to the present disclosure, wherein the temperature of the steam can be greater than 90° C., for example but not limited to a steam temperature may be 100° C., or 150° C., or 200° C., or 250° C., or 300° C., all of which are contained within the protection scope of the disclosure, those skilled in the art can choose the steam temperature according to actual needs. The steam could swell, soak and dissociate the residual adhesive on the surface of the display panel 3, compared with the solubility of organic substances in normal temperature water, the solubility of organic substances in the high-temperature steam is higher, thusly having a better cleaning effect.

TABLE 1

The data graph showing water surface tension is affected by temperature

| | Temperature (° C.) | | | | | |
|---|---|---|---|---|---|---|
| | 0 | 20 | 40 | 60 | 80 | 100 |
| Surface tension (dyne/cm) | 75.64 | 72.75 | 69.59 | 66.18 | 62.61 | 58.85 |

Refer to FIG. 3, according to a specific embodiment of the disclosure, the cleaning device may also include a cleaning fluid supply module 300 which may include a liquid vessel 310 and a pipeline 320, the pipeline 320 may be connected to the sweeping module 100 and washing module 200 respectively, to transfer the cleaning fluid within the liquid vessel 310 to the sweeping module 100 and the washing module 200.

Figure 6:
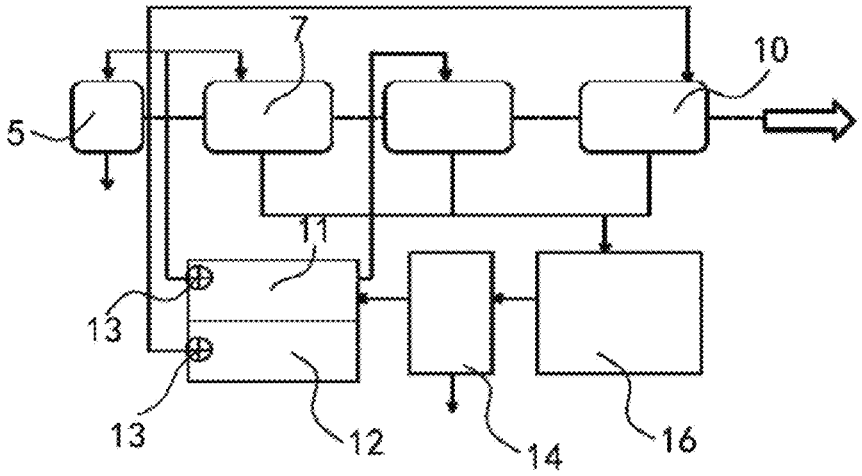
FIG. 6 is a flow chart of a cleaning fluid supply module in FIG. 4.

With continued reference to FIG. 3 to FIG. 5, according to a specific embodiment of the disclosure, in the cleaning direction, the sweeping module 100 and the washing module 200 may be sequentially disposed, the sweeping module 100 first cleans the display panel 3, then the washing module 200 washes it with a cleaning fluid, to separate the dirt from the display panel 3. According to an specific embodiment of the disclosure, wherein in the direction of movement of the display panel, the washing module 200 may include a first cleaning portion 8, a second cleaning portion 9 and a final cleaning portion 10 arranged in sequence in the cleaning direction, the liquid vessel 310 may include a first liquid vessel 12 and a second liquid vessel 11 separated from each other, the liquid outlet of the first liquid vessel 12 may be communicated with the final cleaning portion 10, the liquid outlet of the second liquid vessel 11 may be communicated with the first cleaning portion 8 and the second cleaning portion 9 respectively, the liquid outlet of the first cleaning portion 8, the liquid outlet of the second cleaning portion 9 and the liquid outlet of the final cleaning portion 10 are communicated with the liquid return ports of the second liquid vessel 11 respectively. According to an specific embodiment of the disclosure, the liquid vessel 310 may also include a third liquid vessel 16 which can be communicated with the second liquid vessel 11, the third liquid vessel 16 can be used to collect waste liquid discharged from the first cleaning portion 8, the second cleaning portion 9 and the final cleaning portion 10, The waste liquid can be purified by the sewage purification device 14 and then return to the second liquid vessel 11 again, to participate in the cleaning process for the next display panel 3. By means of the third liquid vessel 16, the sewage purification device 14, and the second liquid vessel 11 communicated successively, it can be more environmentally friendly. With continued reference to FIG. 6, the cleaning fluid in the second liquid vessel 11 is passed into the steam generator 5 to generate steam to act on the surface to be cleaned of the display panel 3, the liquid cleaning fluid produced in this process will be directly discharged from the cleaning device. The direction of the arrow in FIG. 6 is the flow direction of the cleaning fluid.

Figure 7:
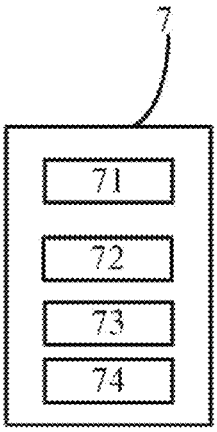
FIG. 7 is a block diagram of a brush component in FIG. 3.
Figure 8:
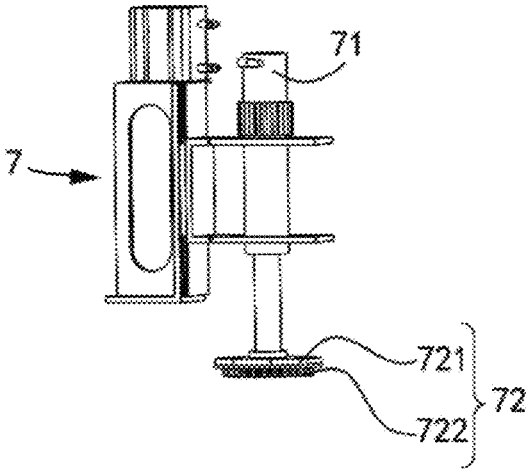
FIG. 8 is a schematic structural view of the brush component in FIG. 3.
Figure 9:
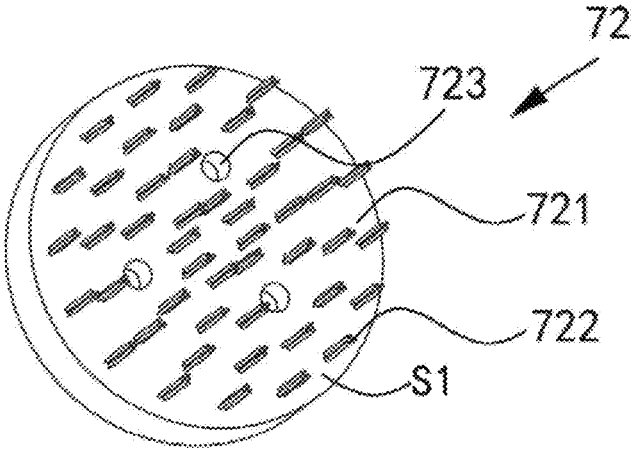
FIG. 9 is a schematic structural view of a cleaning face of a brush in FIG. 8.

With continued reference to FIG. 7 to FIG. 9, according to a specific embodiment of the disclosure, the brush component 7 may include a brush 72, an actuator 71, a pressure sensor 73 and a controller 74. The cleaning face of the brush may be disposed towards the display panel 3, and parallel to the display panel 3. The actuator 71 can drive the brush 72 to move, for example but not limited to drive the brush 72 to move on the surface to be cleaned of the display panel 3 to sweep the surface to be cleaned; the actuator 71 may also drive the brush 72 to move in the direction perpendicular to the surface to be cleaned of the display panel 3 to be close to or away from the display panel 3, thus the pressure of the cleaning face of the brush 72 can be adjusted. The pressure sensor 73 may be used to measure the pressure of the cleaning face of the brush 72, and transmit the measured pressure signal to the controller 74. The controller 74 is electrically connected to the actuator 71 and the pressure sensor 73 respectively, receives the pressure signal measured by the pressure sensor 73, and generates a control signal according to the pressure information for transmitting to the actuator 71.

The pressure sensor 73 can measure the stress acting on the display panel 3 in real time, thereby preventing damage to the display panel 3 due to excessive stress from the brush 72, in addition, avoiding incomplete clean due to insufficient stress between the brush 72 and the display panel 3. Further, in case of a worn brush 72, by the cooperation of the controller 74, the pressure sensor 73 and the brush 72, the stress between the brush 72 and the display panel 73 can be maintained constant. According to a specific embodiment of the disclosure, the pressure sensor 73 and/or the controller 74 can be integrated inside the brush 72, it can also be formed outside of the brush 72, all of which are contained within the protection scope of the present disclosure.

With continued reference to FIG. 8 and FIG. 9, according to a specific embodiment of the disclosure, wherein the brush 72 may be a plate-type brush which may include a plate body part 721 and a brush part 722. The plate body part 721 may have a first surface S1, the first surface S1 may be parallel to the cleaning face. The brush part 722 may be disposed on the first surface, and the extend direction of the brushing of the bush part 722 may be perpendicular to the first surface S1. The plate body part 721 may be connected with the actuator 71 to support the brush part 722. According to a specific embodiment of the disclosure, wherein a water outlet hole 723 may be further provided on the first surface S1 of the plate body part 721, the water outlet hole 723 can be communicated with the liquid vessel 310 through the pipeline 320, such that the display panel 3 could be swept while washed by the brush component 7, thusly improving the cleaning efficiency. The brush 72 provided by the present disclosure is a plate-type brush, which could avoid the problem of line contact between a roller-type brush and the display panel 3, thusly avoiding the problem of local stress concentration of the display panel 3 to a certain degree.

According to a specific embodiment of the disclosure, wherein the cleaning fluid supply module 300 may also include a heating device 13 which heats the cleaning fluid. The heating device 13 is disposed on the pipeline 320, and/or the heating device 13 is disposed in the liquid vessel 310. According to a specific embodiment of the disclosure, wherein the cleaning fluid may be heated to a temperature about 40° C. to 50° C. by the heating device 3 with error of 5° C., for example, is 35° C., 39° C., 41° C., 51° C., 55° C. The cleaning fluid heated by the heating device 13 can be passed into the steam generator 5; in addition, the cleaning fluid heated by the heating device 13 can also be passed into the brush 72, such that the display panel 3 could be swept while washed, thusly improving the cleaning efficiency; in addition, the cleaning fluid heated by the heating device 13 can also be passed into the washing module 200, thusly further improving washing efficiency. Specifically, the cleaning fluid heated by the heating device 13 can prevent re-solidification of the organic grease such as residual adhesive that has been soaked by steam, so that the washing efficiency can be improved.

According to a specific embodiment of the disclosure, a cleaning method is provided, which uses above mentioned cleaning device for cleaning, wherein the cleaning method includes the following steps: a steam generating component 19 generates steam to act on the surface to be cleaned of display panel 3, the steam can fully soak the organic grease such as residual adhesive on the display panel 3 so as to prepare for the subsequent sweeping and washing processes. The brush component 7 can first sweep one surface of the display panel 3; After the one surface, for example but not limited to a surface of the color film, is swept, then sweep the other surface, which may be a surface of the thin film transistor, and the one surface and the other surface may be oppositely disposed. Then washing the cleaned display panel 3 by using the washing module 200. In the cleaning method of the display panel provided by the present disclosure, different surfaces to be cleaned of the display panel 3 are cleaned respectively, such that it is possible to avoid opposing forces acting on the opposite surfaces of the display panel 3 at the same time, thusly avoiding the problem that the strength of the display panel itself is impaired. According to a specific embodiment of the disclosure, the heating device 13 can be used to heat the cleaning fluid before the washing module 200 performs the washing step to the display panel 3.

The steam generating component 19 of the cleaning device of the present disclosure may include a steam generator 5 and a steam ejector 6. The steam generator 5 can heats cleaning fluid from liquid into steam, then the steam ejector 6 can spray the steam on the surface of the display panel 3 to be cleaned to soak and soften organic grease such as residual adhesive, so as to prepare for subsequent cleaning and washing. The cleaning device may also include cleaning fluid supply module 300, the cleaning fluid supply module 300 is configured to transport the cleaning fluid to the sweeping module 100 and the washing module 200. The cleaning fluid supply module 300 may include a heating device 13, which is used to heat the cleaning fluid so as to perform clean process subsequently. Therefore, it is possible to prevent the organic grease, which has been soaked and softened, from being re-solidified, thereby improving the cleaning efficiency.

Based on the above technical solutions, it can be seen that the advantages and positive effects of the cleaning device and cleaning method of the present disclosure are as follows: Steam is generated by the steam generating component and applied to the surface of the parts to be cleaned, so that dirt, for example but not limited to, residual adhesive, remaining on the surface of the parts to be cleaned can be soaked and softened, so that the brush component can clean it, thusly improving cleaning efficiency.

The features, structures, or properties described herein may be incorporated into one or more implementations in any suitable manner. In the above description, numerous specific details are provided to provide a thorough understanding of embodiments of the present disclosure. However, those skilled in the art will realize that the aspects of the disclosure may be practiced without one or more specific details or by means of other methods, components and materials, etc. Under the other circumstances, well-known structures, materials, or operations are not shown or described in detail to avoid obscuring variable aspects of the disclosure.

What is claimed is:

1. A cleaning device, comprising:

a sweeping module, comprising a brush component and a steam generating component, arranged in sequence in a cleaning direction of the cleaning device;

a washing module, configured to wash a part to be cleaned, wherein the washing module and the sweeping module are arranged in sequence in the cleaning direction of the cleaning device, and a cleaning fluid supply module which comprises a liquid vessel and a pipeline, the pipeline is communicated with the sweeping module and the washing module respectively, wherein in a direction of movement of the part to be cleaned, the washing module comprises a first cleaning portion, a second cleaning portion and a final cleaning portion arranged in sequence, the liquid vessel comprises a first liquid vessel and a second liquid vessel separated from each other, a liquid outlet of the first liquid vessel is communicated with the final cleaning portion, a liquid outlet of the second liquid vessel is communicated with the first cleaning portion and the second cleaning portion respectively, the liquid outlet of the first cleaning portion, the liquid outlet of the second cleaning portion and a liquid outlet of the final cleaning portion are communicated with a liquid return port of the second liquid vessel respectively.

2. The cleaning device according to claim 1, wherein the brush component comprises a brush, an actuator, a pressure sensor and a controller, a cleaning face of the brush is disposed towards and parallel to the part to be cleaned; the actuator is configured to drive the brush to move; the pressure sensor is configured to measure a pressure of the cleaning face of the brush, and transmit a pressure signal to the controller; the controller is electrically connected to the actuator and the pressure sensor respectively; the controller is configured to receive the pressure signal from the pressure sensor, and generate a control signal according to the pressure signal for transmitting to the actuator.

3. The cleaning device according to claim 2, wherein the brush is a plate-type brush and comprises a plate body part and a brush part, the plate part comprises a first surface which is parallel to the cleaning face, the brush part is disposed on the first surface, and an extend direction of a brushing of the brush part is perpendicular to the first surface; the plate body part is connected with the actuator.

4. The cleaning device according to claim 1, wherein the steam generating component comprises a steam generator and a steam ejector, a steam generated by the steam generator is sprayed by the steam ejector to a surface to be cleaned of the part to be cleaned.

5. The cleaning device according to claim 4, wherein a temperature of the steam is greater than 90° C.

6. The cleaning device according to claim 1, wherein the cleaning fluid supply module further comprises a heating device, which is configured to heat the cleaning fluid and disposed on the pipeline, and/or in the liquid vessel.

7. The cleaning device according to claim 6, wherein a temperature of the cleaning fluid after being heated by the heating device is about 40° C. to 50° C.

8. The cleaning device according to claim 1, further comprising a camera device, an air knife unit and an optical detection device, the camera device, the sweeping module, the washing module, the air knife unit and the optical detection device are sequentially arranged in the cleaning direction in sequence.

9. A cleaning method, wherein the cleaning method uses the cleaning device according to claim 1 for cleaning, the cleaning method comprises the following steps:

generating steam by the steam generating component to act on the part to be cleaned;

sweeping one surface of the part to be cleaned by the brush component;

after the one surface is swept, then sweeping the other surface, which is opposite to the one surface; and washing the part to be cleaned after being swept with the washing module.

10. The cleaning method according to claim 9, wherein the steam generating component comprises a steam generator and a steam ejector, the step of generating steam by the steam generating component to act on the part to be cleaned comprises:

heating cleaning fluid from liquid into steam by the steam generator, and spraying the steam on the part to be cleaned by the steam ejector.

11. The cleaning method according to claim 9, wherein the cleaning device further comprises a cleaning fluid supply module which is configured to transport cleaning fluid to the sweeping module and the washing module, the cleaning fluid module comprises a heating device, before the step of washing the part to be cleaned after being swept with the washing module, heating the cleaning fluid by the heating device.

12. The cleaning method according to claim 9, wherein the part to be cleaned is a display panel.

* * * * *